US006201375B1

(12) United States Patent
Larson et al.

(10) Patent No.: US 6,201,375 B1
(45) Date of Patent: Mar. 13, 2001

(54) OVERVOLTAGE SENSING AND CORRECTION CIRCUITRY AND METHOD FOR LOW DROPOUT VOLTAGE REGULATOR

(75) Inventors: Tony R. Larson; David A. Heisley, both of Tucson, AZ (US)

(73) Assignee: Burr-Brown Corporation, Tucson, AZ (US)

( * ) Notice: Subject to any disclaimer, the term of this patent is extended or adjusted under 35 U.S.C. 154(b) by 0 days.

(21) Appl. No.: 09/560,376

(22) Filed: Apr. 28, 2000

(51) Int. Cl.[7] ..... G05F 1/573

(52) U.S. Cl. ..... 323/277; 323/280; 323/281; 361/18; 361/91

(58) Field of Search ..... 323/277, 280, 323/274, 275, 281; 361/18, 91

(56) References Cited

U.S. PATENT DOCUMENTS

| | | | | |
|---|---|---|---|---|
| 4,796,174 | | 1/1989 | Nadd | 363/60 |
| 4,908,566 | | 3/1990 | Tesch | 323/280 |
| 5,559,424 | * | 9/1996 | Wrathall et al. | 323/277 |
| 5,563,501 | | 10/1996 | Chan | 323/282 |
| 5,625,278 | | 4/1997 | Thiel et al. | 323/280 |
| 5,631,598 | | 5/1997 | Miranda et al. | 327/540 |
| 5,648,718 | | 7/1997 | Edwards | 323/274 |
| 5,675,241 | | 10/1997 | Teggatz et al. | 323/282 |
| 5,705,919 | | 1/1998 | Wilcox | 323/282 |
| 5,764,460 | * | 6/1998 | Perillo et al. | 323/277 |
| 5,850,139 | | 12/1998 | Edwards | 323/280 |
| 5,852,359 | | 12/1998 | Callahan, Jr. et al. | 323/274 |
| 5,864,227 | | 1/1999 | Borden et al. | 323/280 |
| 5,929,617 | | 7/1999 | Brokaw | 323/280 |
| 5,939,867 | | 8/1999 | Capici et al. | 323/277 |
| 5,982,226 | | 11/1999 | Rincon-Mora | 327/541 |
| 6,005,374 | | 12/1999 | Tasdighi | 323/273 |

OTHER PUBLICATIONS

Unitrode UCCX83 LDO Voltage Regulator, Integrated Circuits, 12/94A, UCC283–3/–5/–ADJ.

SGS–Thomson–L4955 LDO Voltage Regulator, 2/14, Low Dropout 3 Ampere Linear Regulator Family. No Pages.

* cited by examiner

*Primary Examiner*—Shawn Riley
(74) *Attorney, Agent, or Firm*—Cahill, Sutton & Thomas P.L.C.

(57) ABSTRACT

An LDO voltage regulator includes an error amplifier having a first input coupled to a first reference voltage, a second input receiving a feedback signal, and an output producing a first control signal. An output transistor has a gate, a drain coupled to an unregulated input voltage, and a source coupled to produce a regulated output voltage on an output conductor. A feedback circuit is coupled between the output conductor and a second reference voltage. An overvoltage comparator has a first input coupled to receive the first reference voltage and a second input coupled to respond to the feedback signal to produce a discharge control signal indicating occurrence of an output overvoltage of at least a predetermined magnitude to control a discharge transistor coupled between the output conductor and the second reference voltage. An output current sensing circuit produces a control current representative of the drain current of the output transistor. An offset capacitor is coupled between the output of the error amplifier and the gate of the output transistor, and a servo amplifier has a first input coupled to receive a third reference voltage, a second input coupled to the output of the error amplifier, and an output coupled to the gate of the output transistor to produce a second control signal thereon. A current sensor circuit, a current capacitor, and an AND circuit operate to allow the discharge transistor to be turned on only if the output current is below a certain level.

30 Claims, 6 Drawing Sheets

VIN
51
12
VOUT
VFB
VREF
8
M1
M2
3
OVER-V
10
47
M3
M4
23
9
VIN
52
54
40
VIN
49
K*IOUT
DISABLE SERVO
23
HIGH-I
M6
M7
48
VAMPOUT
M5
50
IREF

7
VIN
33
4
4A
12A
56
VGATE
12
57
VOUT
8
5
IOUT
12
LOAD
14
6
24
59
58
25

OVERVOLTAGE SENSING AND CORRECTION CIRCUITRY AND METHOD FOR LOW DROPOUT VOLTAGE REGULATOR

BACKGROUND OF THE INVENTION

The invention relates to low drop out (LDO) voltage regulators, and more particularly to improvements therein which make voltage regulator respond better than prior LDO voltage regulators to output overvoltages caused by rapid load current transients.

FIG. 1 illustrates a low drop out voltage regulator which is believed to be representative of the closest prior art, described in detail in U.S. Pat. No. 5,864,227, by Borden et al. The voltage regulator shown in prior art FIG. 1 includes a P-channel output transistor MPX having its source connected to an unregulated voltage input Vcc and its drain connected to a regulated output voltage $V_{OUT}$. (The "output" transistors referred to herein also are commonly referred to as "pass" transistors.) Its gate is connected to an error amplifier A1 having its (−) input connected to $V_{REF}$ and its (+) input connected to a feedback voltage $V_{FB}$ produced by a voltage divider R1,R2. A discharge circuit PD1 includes a P-channel discharge transistor MPD having its source connected to $V_{OUT}$ and its drain connected to ground. The discharge circuit PD1 includes a comparator C1 having an output connected to the gate of discharge transistor MPD. The (−) input of comparator C1 is connected to the output of error amplifier A1, and the (+) input of comparator C1 is connected to a reference voltage $V_{TRIP}$, which is offset from ground by a suitable amount.

Comparator C1 compares the voltage applied by error amplifier A1 to the gate of output transistor MPX to $V_{TRIP}$ to determine whether or not error amplifier A1 is "in control" of its output, or whether error amplifier A1 has "saturated" in attempting to turn output transistor MPX off. If the output of error amplifier A1 exceeds $V_{TRIP}$, the LDO voltage regulator "assumes" that a $V_{OUT}$ overvoltage condition exists and comparator C1 turns discharge transistor MPD on to discharge the output capacitor CL.

The above prior art LDO voltage regulator has several shortcomings. It does not directly detect the presence of an output overvoltage. Instead, it assumes that there is a $V_{OUT}$ overvoltage whenever error amplifier A1 drives the gate of output transistor MPX above $V_{TRIP}$. But that assumption is not necessarily true. For example, if the feedback control loop is optimized for speed, then the output of error amplifier A1 most likely will exhibit some overshoot in its response to sudden changes in the load current. This could falsely trigger comparator C1 and cause it to turn on discharge transistor MPD. Even without the above mentioned overshoot on the output of error amplifier A1, a rapid decrease in the load current from, for example 100 percent to 50 percent of maximum, may cause comparator C1 to trip and turn on discharge transistor MPD. While this condition may produce a small overvoltage condition, turning on discharge transistor MPD does not actually help the overall recovery from the load current transient because the remaining load current quickly eliminates the $V_{OUT}$ overvoltage condition anyway.

The speed of response of discharge transistor MPD to an overvoltage condition at $V_{OUT}$ depends on both the speed of comparator C1 and the speed of error amplifier A1, the output of which is connected to the (−) input of comparator C1. Comparator C1 may be optimized for response speed, but error amplifier A1 has to drive the large gate capacitance of the large output transistor MPX, and therefore must be optimized for the best overall system operation and compensated for stability. If error amplifier A1 were infinitely fast, output transistor MPX would turn off before it had time to supply the extra charge into output capacitor CL and create a $V_{OUT}$ overvoltage. However, since error amplifier A1 is not infinitely fast it does introduce significant delay into the response of discharge transistor MPD to a $V_{OUT}$ overvoltage event. The delay through error amplifier A1 cannot be eliminated using the approach of U.S. PAt. No. 5,864,227 because the delay through error amplifier A is in fact the main reason that a $V_{OUT}$ overvoltage occurred.

It should be noted that the reference voltage $V_{TRIP}$ in prior art FIG. 1 is unrelated to the $V_{OUT}$ overvoltage. Instead, $V_{TRIP}$ is set to detect when output transistor MPX is sufficiently turned off that it can be inferred that a $V_{OUT}$ overvoltage condition exists. Specifically, the value of $V_{TRIP}$ is set using knowledge of a typical amount of $V_{OUT}$ overvoltage and the typical characteristics of output transistor MPX, rather than by considering the magnitude of a maximum allowable overvoltage at $V_{OUT}$. The trip voltage $V_{TRIP}$ thus is not a function of how far $V_{OUT}$ is into an overvoltage condition in order to activate comparator C1. Instead, $V_{TRIP}$ is determined by the threshold voltage of output transistor MPX and $V_{CC}$.

Furthermore, the LDO voltage regulator of prior art FIG. 1 is prone to small signal oscillations, wherein the voltage regulator alternately goes into and out of overvoltage correction operation when the output load is zero. This can be understood by considering a rapid load transition of $I_{OUT}$ from a heavy load to no load. The regulated output voltage $V_{OUT}$ will rise, and the output of error amplifier A1 will eventually saturate into the $V_{CC}$ rail in an attempt to turn off output transistor MPX as much as possible. This activates comparator C1, which then turns discharge transistor MPD on to discharge output capacitor CL. The speed and dynamics of the LDO voltage regulator of prior art FIG. 1 determine how quickly discharge transistor MPD will turn off after $V_{OUT}$ reaches its specified value of $V_{REF}$ multiplied by (R1+R2)/R1. The same delay through error amplifier A1 that caused the $V_{OUT}$ overvoltage in the first place will also delay the turn off of discharge transistor MPD. During this delay, discharge transistor MPD discharges output capacitor CL to a voltage below the specified value of $V_{OUT}$. $V_{OUT}$ then is too low, so error amplifier A1 slews the gate of output transistor MPX until it turns on enough to increase $V_{OUT}$. Since error amplifier A1 is recovering from its output being saturated into the $V_{CC}$ rail, it is very likely that $V_{OUT}$ will overshoot slightly and charge output capacitor CL too much, creating a new $V_{OUT}$ overvoltage. Since there is no load drawing current to remove the extra charge of output capacitor CL, the resulting $V_{OUT}$ overvoltage remains until the overvoltage correction circuit PD1 is activated again, and the cycle repeats and creates oscillations of $V_{OUT}$.

Thus, there is an unmet need for an improved LDO voltage regulator which dissipates a reduced amount of power, and does not oscillate under no-load conditions.

SUMMARY OF THF INVENTION

Accordingly, it is an object of the invention to provide an improved LDO voltage regulator which reduces the severity of output overvoltage conditions caused by rapid load current transitions.

It is another object of the invention to provide an improved LDO voltage regulator which both rapidly corrects output overvoltage conditions caused by rapid load current transients and which also dissipates a minimum amount of power in discharging such output overvoltage conditions.

It is another object of the invention to provide an improved LDO voltage regulator which rapidly corrects output overvoltage conditions caused by rapid load current transients and which is not prone to signal oscillations due to alternately going into and out of output overvoltage conditions under no-load conditions.

It is another object of the invention to provide an improved LDO voltage regulator which can correct output overvoltage conditions caused by rapid load current transitions on the basis of the magnitude of the output overvoltage conditions.

It is another object of the invention to provide improved LDO voltage regulator circuitry for correcting output overvoltage conditions which is suitable for use in conjunction with either N-channel or P-channel pass transistors.

It is another object of the invention to provide improved LDO voltage regulator circuitry for correcting output overvoltage conditions which is suitable for use in conjunction with offset capacitor and gate servo circuitry coupled between the output of the error amplifier and the gate of the pass transistor.

Briefly described, and in accordance with one embodiment thereof, the invention provides a voltage regulator including an error amplifier (2) having a first input coupled to a first reference voltage ($V_{REF}$), a second input receiving a feedback signal (8), and an output (23) producing a first control signal, an output transistor (4) having a gate, a drain coupled to an unregulated input voltage ($V_{IN}$), and a source coupled to produce a regulated output voltage ($V_{OUT}$) on an output conductor (12), a feedback circuit (5,6) coupled between the output conductor (12) and a second reference voltage (GND), the feedback circuit producing the feedback signal (8), an overvoltage comparator (9) having a first input coupled to receive the first reference voltage ($V_{REF}$), a second input coupled to respond to the feedback signal (8) to produce a discharge control signal (20) indicating occurrence of an output overvoltage of at least a predetermined magnitude, and a discharge transistor (10) coupled between the output conductor (12) and the second reference voltage (GND) and a gate responsive to the discharge control signal (20) to discharge the output overvoltage if the output overvoltage is of at least the predetermined magnitude. The overvoltage comparator (9) has an input offset voltage ($V_{OFS}$) which prevents insignificant changes in the output voltage from turning on the discharge transistor and/or causing no-load oscillations.

In one embodiment, an output current sensing circuit (25) operates to produce a control current (24) representative of the output current ($I_{OUT}$) A current comparator (17) has an output (19), a first input (18) coupled to receive a reference current ($I_{REF}$) and a second input (24) coupled to receive the control current (24) representative of the output current. An ANDing circuit (21) has a first input coupled to the output (20) of the overvoltage comparator (9), a second input coupled to the output (19) of the current comparator (17), and an output (22) coupled to the gate of the discharge transistor (10).

In another embodiment, a capacitor (32) is coupled between the output (23) of the error amplifier (2) and the gate (33) of the output transistor (4), and a servo amplifier (30) has a first input (31) coupled to receive a third reference voltage ($V_{SERVOREF}$), a second input coupled to the output (23) of the error amplifier, and an output (33) coupled to the gate of the output transistor (4) to produce a second control signal thereon. In some embodiments, a low current charge pump circuit (44) coupled to supply an output current into a supply voltage terminal (45) of the servo amplifier (30), and operates to maintain a predetermined DC voltage across the capacitor (32).

FIG. 9 is a schematic diagram of the current sensor 25 shown in FIGS. 3, 5 and 6.

DETAILED DESCRIPTION OF THF PREFERRED EMBODIMENTS

Figure 1:
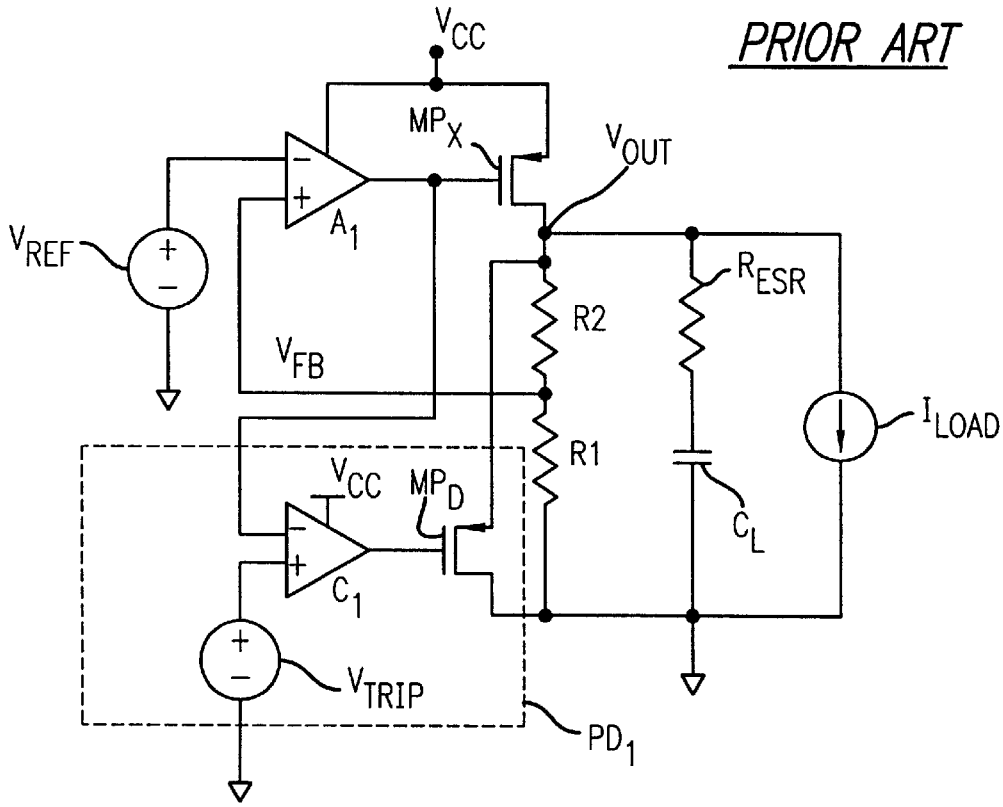
FIG. 1 PRIOR ART
FIG. 1 is a schematic diagram of a prior art LDO voltage regulator.
Figure 2:
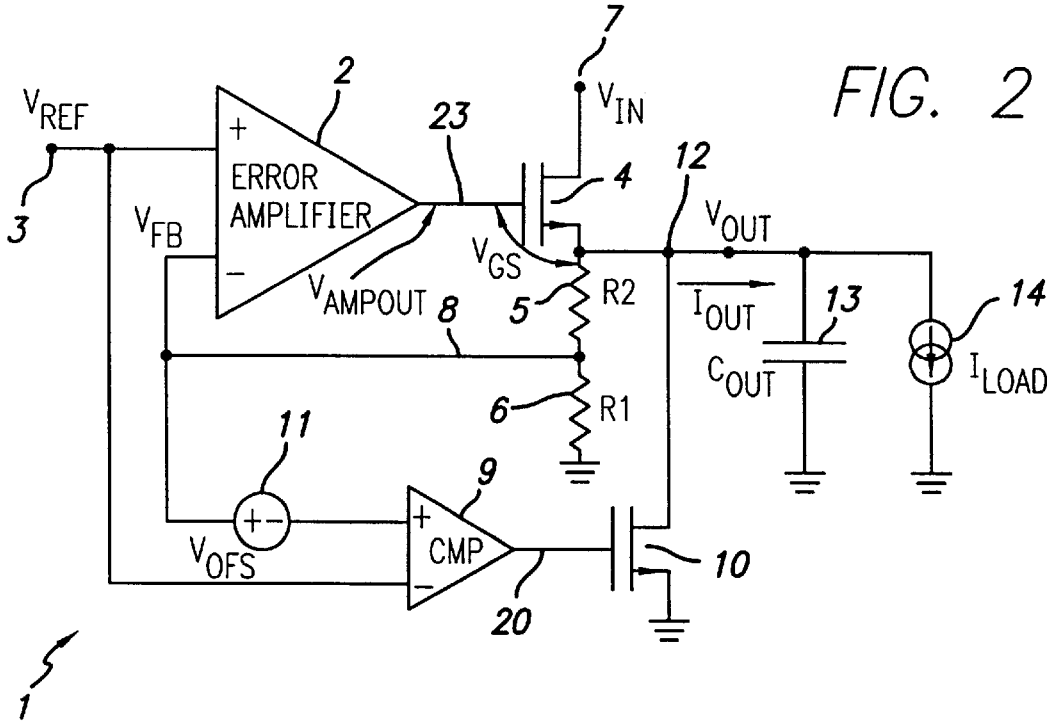
FIG. 2 is a schematic diagram of a first embodiment of an LDO voltage regulator according to the invention.

Referring to FIG. 2, LDO voltage regulator 1 includes N-channel output transistor 4 having its drain connected to an unregulated input supply voltage $V_{IN}$ on conductor 7. The source of transistor 4 is connected to conductor 12, on which a regulated output voltage $V_{OUT}$ is produced. A large capacitor 13 representing an output capacitance $C_{OUT}$ is connected between conductor 12 and ground. A variable load 14 that draws a variable load current $I_{LOAD}$ from output conductor 12 is connected between output conductor 12 and ground. Resistors 5 and 6 are connected in series between output conductor 12 and ground, and the form a voltage divider which produces a feedback signal $V_{FB}$ on conductor 8. $V_{FB}$ is applied to the (–) input of an error amplifier 2 having its (+) input connected by conductor 3 to receive a reference voltage $V_{REF}$. The output of error amplifier 2 is connected by conductor 23 to the gate of output transistor 4.

In accordance with the present invention, an N-channel discharge transistor 10 has its drain connected to output conductor 12 and its source connected to ground. The gate of discharge transistor 10 is connected by conductor 20 to the output of an overvoltage comparator 9. An offset voltage source 11 of voltage $V_{OFS}$ has its (–) terminal connected to the (+) input of overvoltage comparator 9. The (+) terminal of voltage source 11 is connected to feedback conductor 8. The (–) input of overvoltage comparator 9 is connected to $V_{REF}$.

As a practical matter, offset voltage source 11 as shown in the drawings in series with an input of a comparator actually represents an input offset voltage of the comparator. That input offset voltage (i.e., $V_{OFS}$ in FIG. 2) is provided by making the W/L (channel-width-to-channel-length) ratio of the (+) input transistor of the comparator different than the W/L ratio of the (–) input transistor thereof Voltage regulator 1 of FIG. 2 is the simplest implementation of the present invention for detecting and speeding up recovery from a $V_{OUT}$ overvoltage condition. As explained above, $V_{OUT}$ overvoltage conditions occur as a result of rapid transitions of the load current $I_{OUT}$ from a large value to a low value or zero. That is, the overvoltage condition occurs because there is a finite response time of error amplifier 2 in the feedback loop. During full load $I_{OUT}$ conditions, output transistor 4 is turned on hard to supply a large output current $I_{OUT}$. If $I_{OUT}$ suddenly decreases, the error amplifier feedback loop can not instantly turn output transistor 4 off, so output transistor 4 continues to supply the large $I_{OUT}$ current into output capacitance $C_{OUT}$ until error amplifier 2 responds to a feedback voltage $V_{FB}$, which represents the $V_{OUT}$ overvoltage that is produced as a result of the current $I_{OUT}$ still being supplied by output transistor 4 into output capacitance $C_{OUT}$ instead of load 14, which has stopped accepting output current.

However, until a relatively large $V_{OUT}$ overvoltage exists, error amplifier 2 is not driven hard enough to turn output transistor 4 off quickly. To turn output transistor 4 off quickly, its gate voltage on conductor 23 must be driven lower by a relatively large amount. The feedback loop compensation, combined with the large gate capacitance of output transistor 4, limits the slew rate of error amplifier 2 and the delay through error amplifier 2 limits the response time of output transistor 4 and therefore determines the magnitude of the overvoltage experienced by $V_{OUT}$.

Once output transistor 4 is fully turned off, output capacitance $C_{OUT}$ is essentially isolated from the voltage rail $V_{IN}$ and ground. Output capacitance $C_{OUT}$ therefore holds the $V_{OUT}$ overvoltage, as there is no path through which $C_{OUT}$ can be discharged other than the very high impedance path of resistors 5 and 6. Therefore, error amplifier 2 continues to see an error voltage across its inputs, and continues to respond by lowering the gate voltage of output transistor 4 until its output 23 saturates into the ground rail. This only worsens the recovery time of the feedback loop by requiring error amplifier 2 to slew output 23 up even further when it eventually becomes necessary to turn output transistor 4 on again (i.e., when load 14 again begins to accept output current $I_{OUT}$).

To solve the above problems, voltage regulator 1 of FIG. 2 uses overvoltage comparator 9 to directly detect when $V_{OUT}$ is at an overvoltage level, and then turns on discharge transistor 10. The voltage source 11 provides offset voltage $V_{OFS}$ to set a threshold for the amount of the $V_{OUT}$ overvoltage required to trigger overvoltage comparator 9 so it turns on discharge transistor 10. Offset voltage source $V_{OFS}$ eliminates the above mentioned small signal oscillations by causing discharge transistor 10 to be turned off before it can create an undervoltage of $V_{OUT}$. Overvoltage comparator 9 is much faster than error amplifier 2, and this enables discharge transistor 10 to begin discharging output capacitor 13 sooner, lessening the duration and amount of the $V_{OUT}$ overvoltage. The offset voltage $V_{OFS}$ also reduces the frequency of false triggering of overvoltage comparator 9 in response to small errors in $V_{OUT}$ that arise from insignificant fluctuations in $I_{OUT}$.

Without $V_{OFS}$, discharge transistor 10 may discharge output capacitance $C_{OUT}$ to a slight undervoltage condition before discharge transistor 10 turns off. If that occurs, error amplifier 2 attempts to turn output transistor 4 on harder to correct for the undervoltage error. If error amplifier 2 has been saturated into the ground rail, it will have to slew the gate of output transistor 4 to higher levels for a relatively long time before output transistor 4 turns on. It is very likely that error amplifier 2 then will overshoot and cause output capacitance $C_{OUT}$ to be overcharged. $V_{OFS}$ can be selected to ensure that discharge transistor 10 turns off before an undervoltage condition occurs, and thus can eliminate the possibility of oscillations.

Furthermore, a proper value of $V_{OFS}$ eliminates the possibility of discharge transistor 10 being turned on continuously due to input offset errors in error amplifier 2. If error amplifier 2 has an input offset voltage, it regulates $V_{OUT}$ so as to induce the input offset voltage between the input terminals of error amplifier 2. Without a sufficiently large value of $V_{OFS}$, overvoltage comparator 9 might interpret the input offset voltage of error amplifier 2 as an overvoltage event and turn on discharge transistor 10. The feedback loop would then regulate $V_{OUT}$ to maintain the input offset voltage between the inputs of error amplifier 2, which would cause discharge transistor 10 to remain on continuously. That would waste power and possibly overheat voltage regulator 1. A proper value of $V_{OFS}$ ensures that small input offset errors of error amplifier 2 and overvoltage comparator 9 do not cause false triggering of discharge transistor 10.

Figure 3:
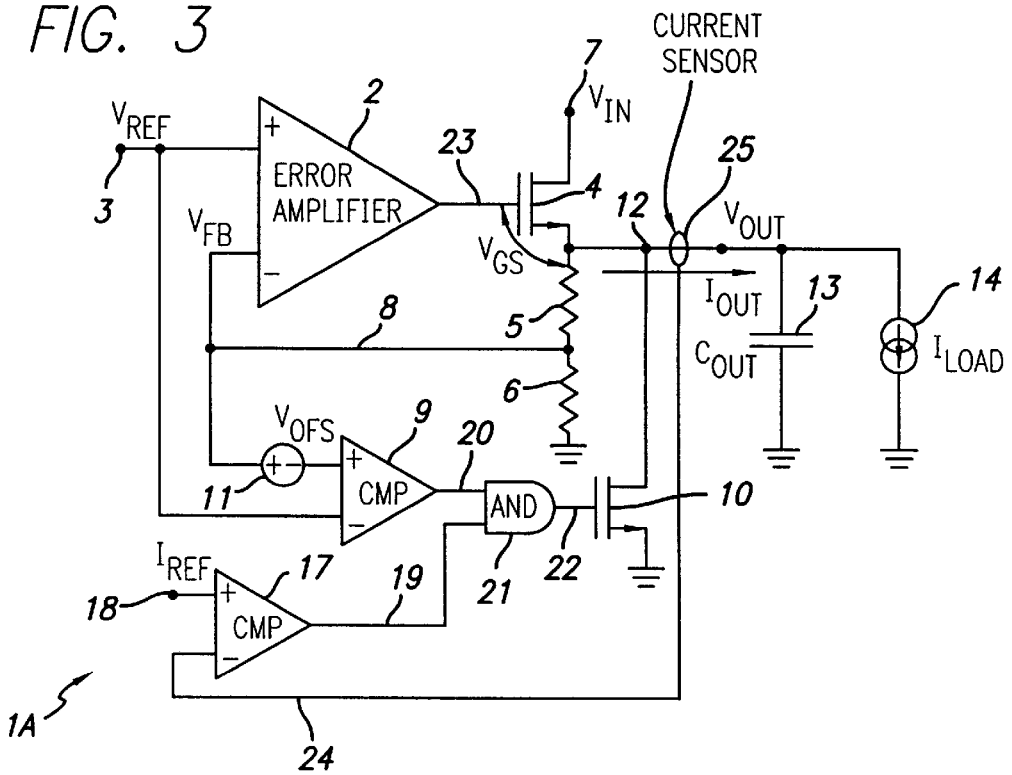
FIG. 3 is a schematic diagram of a second embodiment of an LDO voltage regulator according to the invention.
Figure 9:
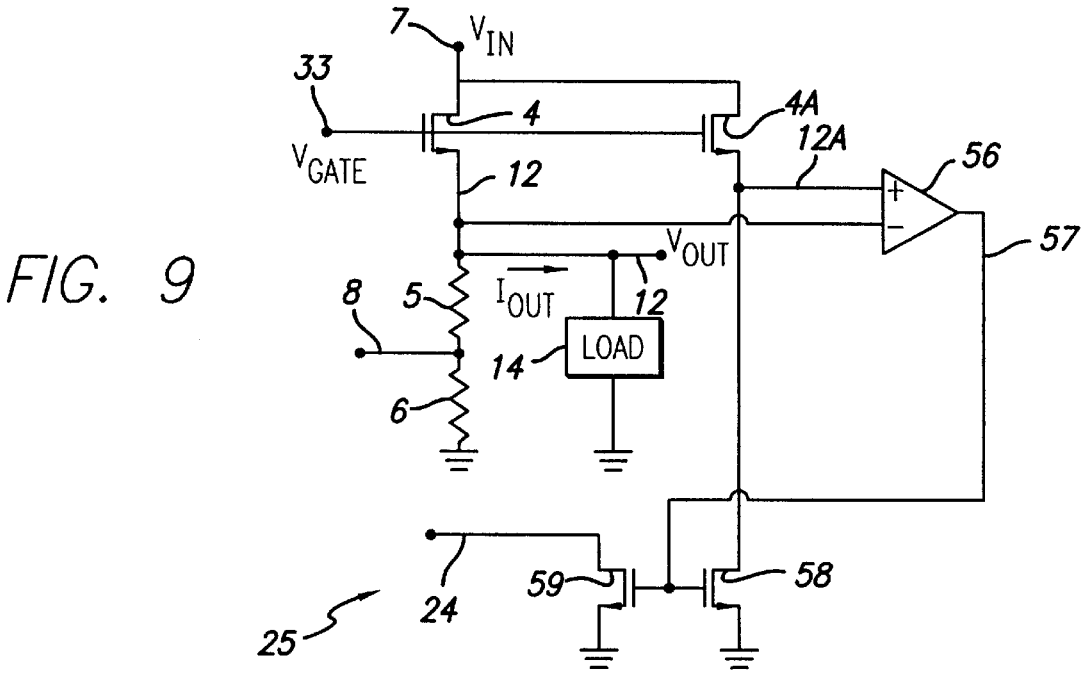

Referring to FIG. 3, large negative-going load current transients cause positive voltage spikes on output conductor 12. However, in accordance with the present invention, if there is a sufficient amount of load current $I_{LOAD}$ in load 14 at the end of the negative-going load current transient to quickly discharge output capacitor 13, then the load is allowed to carry the discharge current instead of turning discharge transistor 10 on. This reduces the power dissipation of the chip. In FIG. 3, voltage regulator 1A is similar to voltage regulator 1 of FIG. 2, but further includes an AND gate 21 having its output connected by conductor 22 to the gate of discharge transistor 10. One input of AND gate 21 is connected by conductor 22 to the output of comparator 9. The other input of AND gate 21 is connected by conductor 19 to the output of a reference current comparator 17. The (−) input of reference current of comparator 17 is connected by conductor 24 to a current sensor 25, which produces a signal representative of the load current $I_{LOAD}$. (Current sensor 25 is shown in FIG. 9, described subsequently.) The (+) input of reference current comparator 17 is connected to conductor 18. A reference current $I_{REF}$ flows into conductor 18.

Voltage regulator 1A of FIG. 3 illustrates how current sensor 25 may be used to ensure that discharge transistor 10 is turned on only when actually necessary. As in FIG. 2, overvoltage comparator 9 detects when a $V_{OUT}$ overvoltage condition exists. Reference current comparator 17 determines when a scaled representation of $I_{OUT}$ is lower than the threshold current $I_{REF}$. When the outputs of both comparators 9 and 17 are high, then the present $V_{OUT}$ overvoltage is "qualified". Only then is discharge transistor 10 turned on. This ensures that discharge transistor 10 is activated only when it will have a significant effect on $V_{OUT}$, and therefore avoids unnecessary power dissipation that would result from discharge transistor 10 being turned on unnecessarily.

Although the provision of reference current comparator 17 in the circuit of FIG. 3 reduces the occurrence of false turn on of discharge transistor 10, it also may slow down the correction of $V_{OUT}$ overvoltages, because discharge transistor 10 is never activated until a low $I_{OUT}$ condition is sensed by current sensor 25. The benefits of such current sensing must be weighed against the loss of speed in correcting $V_{OUT}$ overvoltages. (It should be noted that this technique and other techniques of the invention as described herein are equally applicable to LDO voltage regulators having either N-channel or P-channel output transistors.)

Figure 4:
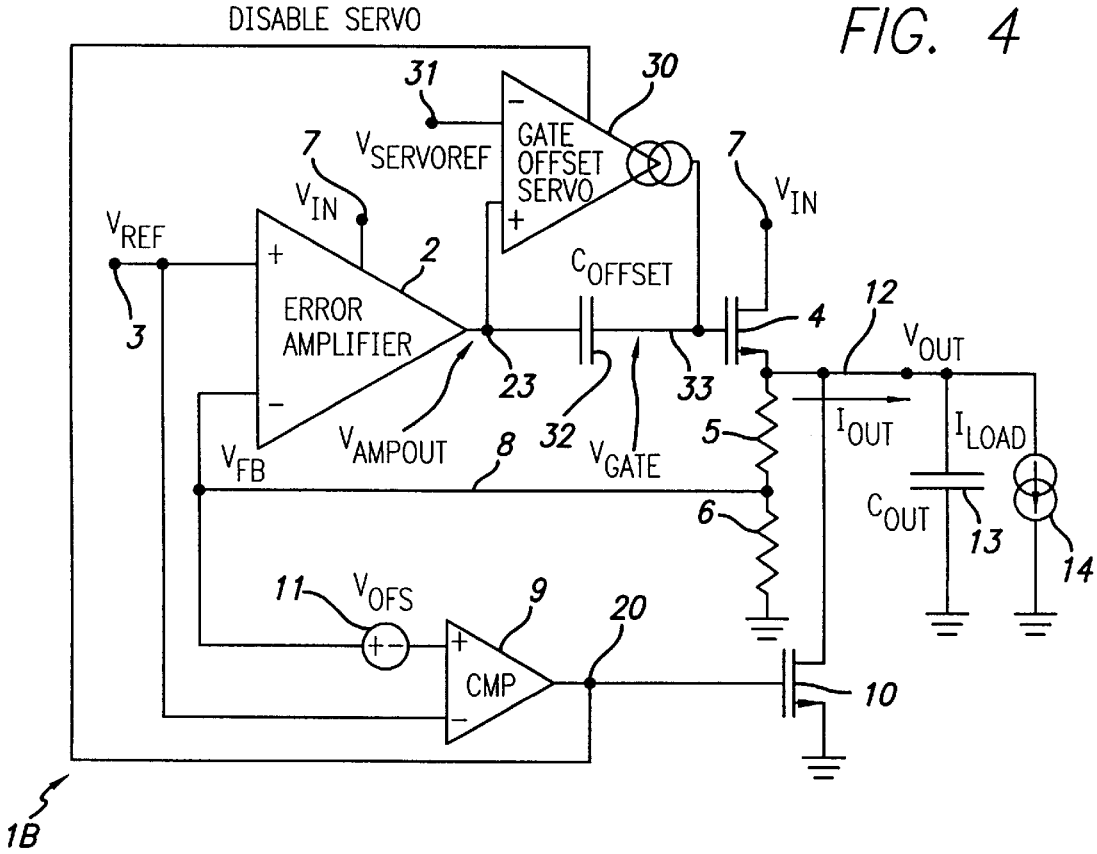
FIG. 4 is a schematic diagram of a third embodiment of an LDO voltage regulator according to the invention.

Referring to FIG. 4, LDO voltage regulator 1B includes all of the elements shown in FIG. 2, and further includes an offset capacitor 32 coupled between the output of error amplifier 2 and the gate of output transistor 4. A servo amplifier 30 has its (+) input connected by conductor 23 to the output of error amplifier 2 and one terminal of offset capacitor 32. Servo amplifier 30 has its output connected by conductor 33 to the other terminal of offset capacitor 32 and the gate of output transistor 4. The (−) input of servo amplifier 30 is connected by conductor 31 to receive a reference voltage $V_{SERVOREF}$. A "disable" input of servo amplifier 30 is connected by conductor 20 to the output of overvoltage comparator 9. The technique of using servo amplifier 30 and offset capacitor 32 in a LDO voltage regulator is fully described in the commonly assigned co-pending patent application entitled "LOW DROPOUT VOLTAGE REGULATOR CIRCUIT INCLUDING GATE OFFSET SERVO CIRCUIT POWERED BY CHARGE PUMP" by Tony Larson, David Heisley, Rodney Burt, and Mark Stitt, Docket No. 0437-A-231, filed on even date herewith.

In the voltage regulator 1B of FIG. 4, servo amplifier 30 ordinarily would begin to discharge offset capacitor 32 during any $V_{OUT}$ overvoltage event, if servo amplifier 30 were "enabled". In that case, if the $V_{OUT}$ overvoltage condition remains long enough for servo amplifier 30 to significantly reduce the DC voltage across offset capacitor 32, then offset capacitor 32 may not be able to maintain enough offset voltage across it for the feedback loop to recover when the load 14 resumes drawing a substantial $I_{OUT}$. If that occurs, the charge pump 44 (FIG. 7) which would be used to provide power to the output stage of servo amplifier 30 must replace all of the charge lost from offset capacitor 32. That would be likely to require a substantial amount of time. To prevent that from occurring, servo amplifier 30 is disabled during any overvoltage event detected by overvoltage comparator 9.

Figure 5:
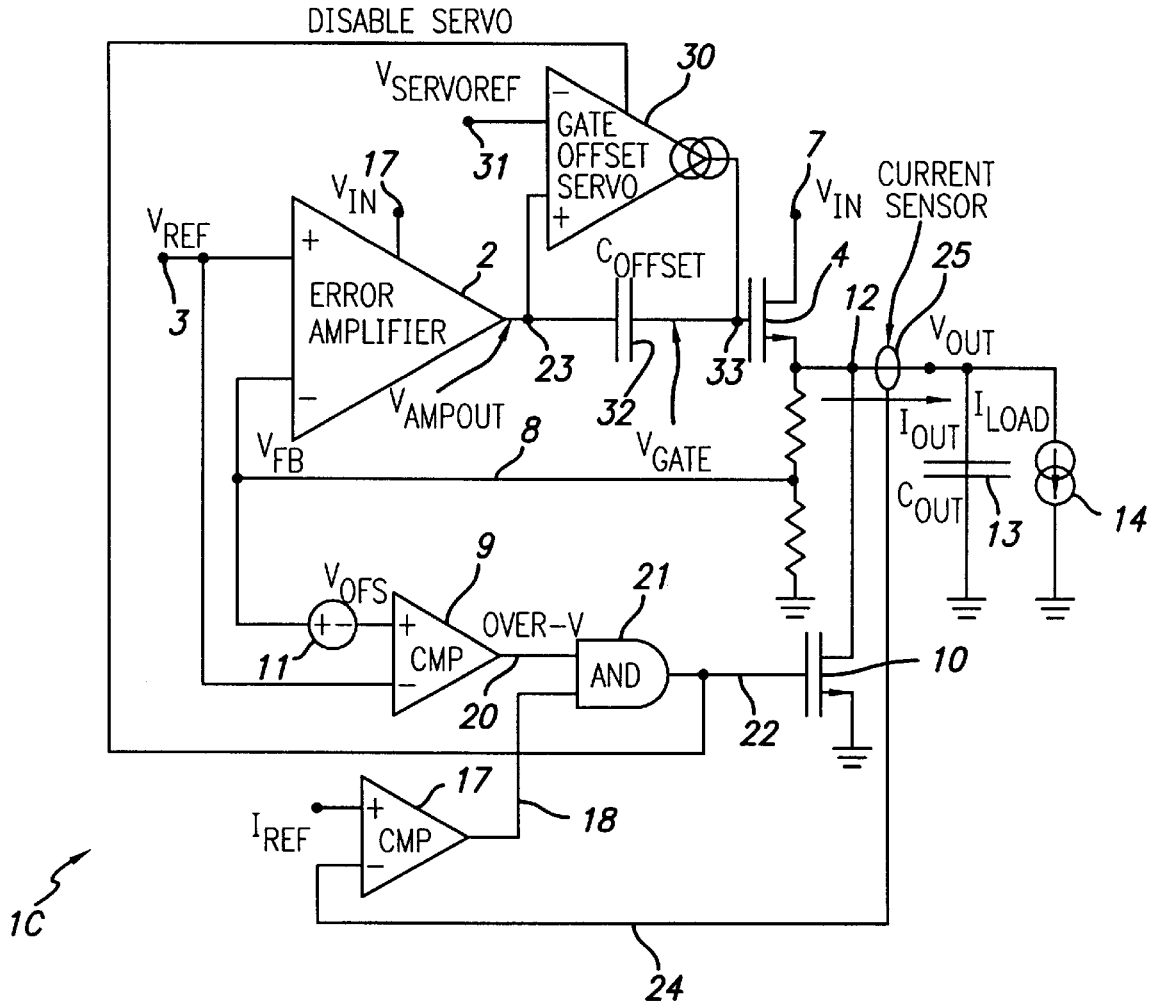
FIG. 5 is a schematic diagram of another embodiment of an LDO voltage regulator according to the invention.

Referring to FIG. 5, LDO voltage regulator IC includes the same elements as voltage regulator 1A in FIG. 3, and further includes servo amplifier 30 and offset capacitor 32, just as shown in voltage regulator 1B of FIG. 4. In FIG. 5, servo amplifier 30 has a disable input connected by conductor 22 to the output of AND gate 21. The voltage regulator 1C of FIG. 5 disables servo amplifier 30 during "qualified" $V_{OUT}$ overvoltage events. There are two requirements for a $V_{OUT}$ overvoltage event to be "qualified". First, the $V_{OUT}$ overvoltage must be large enough that the feedback voltage $V_{FB}$ exceeds the difference between $V_{REF}$ and $V_{OFS}$, so the output of overvoltage comparator 9 is at a high level. Second, $I_{OUT}$ must also be low enough that the current sensor output current in conductor 24 is less then $I_{REF}$, so the output 18 of reference current comparator 17 also is at a high level. If both requirements are met, then the $V_{OUT}$ overvoltage is "qualified". The voltage on conductor 22 then is produced by AND gate 21 and turns on discharge transistor 10, and also constitutes a DISABLE SERVO signal that disables servo amplifier 30 and prevents it from discharging or charging offset capacitor 32 during a "qualified" $V_{OUT}$ overvoltage.

Figure 6:
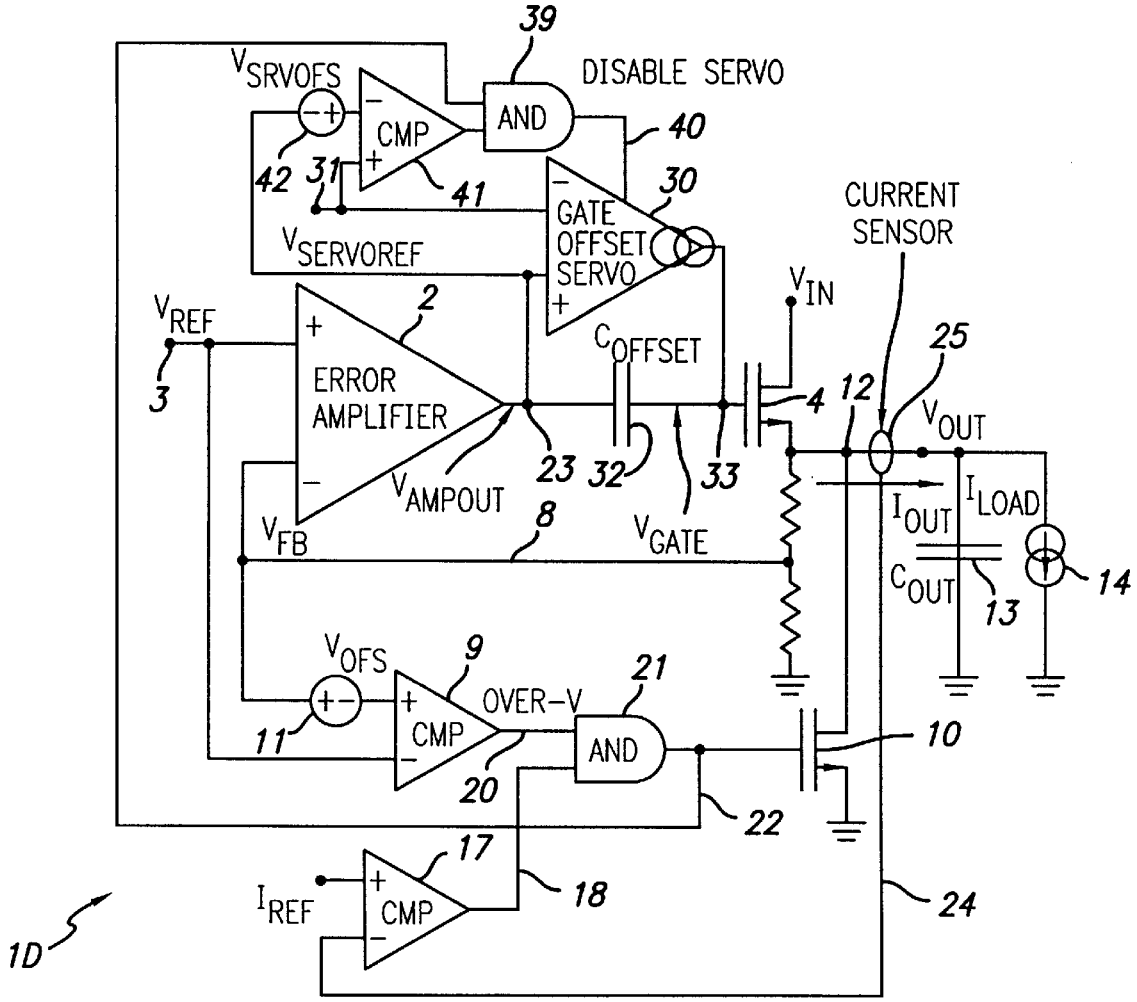
FIG. 6 is a schematic diagram of another embodiment of an LDO voltage regular according to the invention.

FIG. 6 shows a possible modification to voltage regulator 1C of FIG. 5 so as to provide the LDO voltage regulator 1D. Specifically, voltage regulator 1D of FIG. 6 includes circuitry that disables servo amplifier 30 only if it is actually attempting to discharge offset capacitor 32. Voltage regulator 1D includes all of the components shown in the embodiment of FIG. 5, and further includes an AND gate 39 having its output connected by conductor 40 to apply the DISABLE SERVO signal to the disable input of servo amplifier 30. One input of AND gate 39 is connected by conductor 22 to the output of AND gate 21. The other input of AND gate 39 is connected to the output of a servo offset comparator 41 having its (+) input connected to conductor 31. The (−) input of servo offset comparator 41 is connected to the (+) terminal of a voltage source 42, the (−) terminal of which is connected by conductor 23 to the (+) input of servo amplifier 30 and the output of error amplifier 2. Voltage source 42 produces a voltage $V_{SRVOFS}$.

Servo amplifier 30 is disabled only when a "qualified" $V_{OUT}$ overvoltage condition as described above exists and the output $V_{AMPOUT}$ of amplifier 2 is high enough to direct servo amplifier 30 to discharge offset capacitor 32. (Again, a qualified" $V_{OUT}$ overvoltage exists only if (1) $V_{OUT}$ is greater than $V_{REF}$ plus $V_{OFS}$, and (2) $I_{OUT}$ is low enough that the output of current sensor 25 is lower than $I_{REF}$.) Servo amplifier 30 discharges offset capacitor 32 only if output 23 of error amplifier 2 is below the difference between reference voltage $V_{SERVOREF}$ and $V_{SRVOFS}$. Servo offset comparator 41 detects this condition directly, with $V_{SERVOREF}$ setting a threshold for increased detection reliability.

Figure 7:
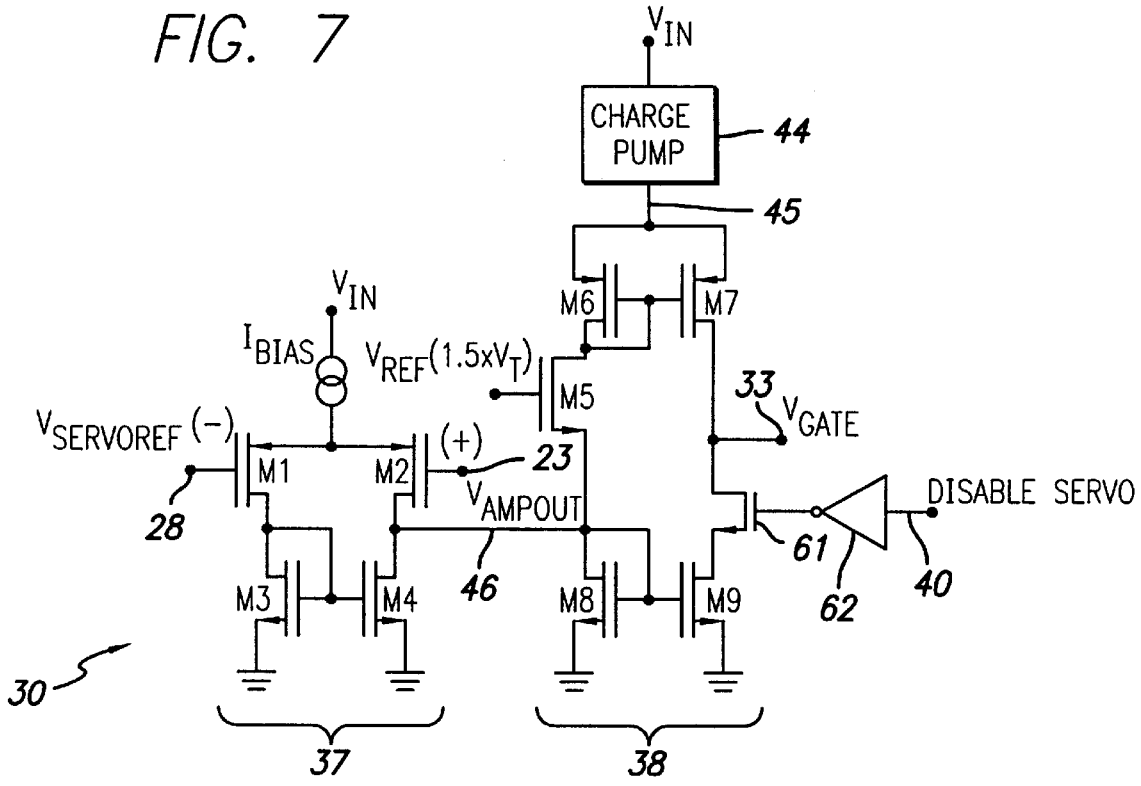
FIG. 7 is a schematic diagram of the servo amplifier in block 30 of FIGS. 4–6.

FIG. 7 is a simplified schematic diagram of servo amplifier 30 as used in the LDO voltage regulator ID of FIG. 6, wherein input stage 37 of servo amplifier 30 includes differentially connected P-channel input transistors M1 and M2 having their sources connected to one terminal of a constant current source $I_{BIAS}$. The other terminal of current source $I_{BIAS}$ is connected to $V_{IN}$. The gate of transistor M1 is connected by conductor 28 to receive $V_{SERVOREF}$ (which may be fixed or variable) and the gate of transistor M2 is connected by conductor 23 to receive the error amplifier output signal $V_{AMPOUT}$. The drain of transistor M1 is connected to the drain of N-channel current mirror input transistor M3 and to the gates of both transistor M3 and N-channel current mirror output transistor M4. The sources of transistors M3 and M4 are connected to ground. The drains of transistors M2 and M4 are connected by conductor 46 to output stage 38 of servo amplifier 30.

Output stage 38 includes diode-connected N-channel transistor M8 which has its source connected to ground and its gate and drain connected to conductor 46. The gate of transistor M8 is connected to the gate of an N-channel transistor M9 having its source connected to ground and its drain connected to the source of an N-channel transistor 61. The gate of transistor 61 is connected to the output of an inverter 62. The drain of transistor 61 is connected to output conductor 33, on which $V_{GATE}$ is produced. The input of inverter 62 receives the DISABLE SERVO signal produced on conductor 40, as shown in FIG. 6. Output stage 38 also includes N-channel transistor M5, which has its source connected to conductor 46 and its gate connected to a reference voltage equal to 1.5 times the threshold voltage $V_T$ of the N-type transistors M5 and M8. The drain of transistor M5 is connected to the drain and gate of a P-channel current mirror input transistor M6 and the gate of a P-channel current mirror output transistor M7. The sources of transistors M6 and M7 are connected by conductor 45 to the output of a charge pump 44. The drain of transistor M7 is connected to output conductor 33.

When the two inputs of servo amplifier 30 are at equal voltages, the tail current $I_{BIAS}$ splits evenly between P-channel transistors M1 and M2. Therefore, no current flows to output conductor 33 from the charge pump supply ($V_{CP}$). However, when the (+) and (−) inputs of input stage 37 of servo amplifier 30 are not balanced, input stage 37 steers all or part of the tail current $I_{BIAS}$ through either transistor M1 or transistor M2.

For example, when there is a positive $V_{OUT}$ overvoltage, error amplilfier 2 causes $V_{AMPOUT}$ to be reduced. When $V_{AMPOUT}$ is lower than $V_{SERVOREF}$, transistor M1 turns off. This turns off transistor M4, and $I_{BIAS}$ flows through transistor M2 and conductor 46 into diode-connected current mirror input transistor M8, which causes a corresponding mirrored current in the drain of transistor M9 to flow out of conductor 33, if transistor 61 is on. The drain current of M9 and transistor 61 reduces $V_{GATE}$ on conductor 33, and the output DMOS transistor 4 would be slightly turned off.

If transistor 61 is off, the servo amplifier 30 is disabled in the sense that transistor M9 can not discharge $V_{GATE}$ and capacitor 32. The signal DISABLE SERVO on conductor 40 causes inverter 62 to turn transistor 61 off if the output of AND gate 39 is high.

When $V_{AMPOUT}$ is higher than $V_{SERVOREF}$, $I_{BIAS}$ flows through transistors M1 and M3. This turns transistor M4 on, which turns transistors M8 and M9 off, and draws current from the source of transistor M5. This causes the current mirror transistors M6 and M7 to draw currents from charge pump output conductor 45. The mirrored current through transistor M7 therefore flows from charge pump output 45 through transistor M7 and output conductor 33, increasing $V_{GATE}$ and charging offset capacitor 32, and the feedback loop quickly produces a corresponding change in $V_{AMPOUT}$.

Figure 8:
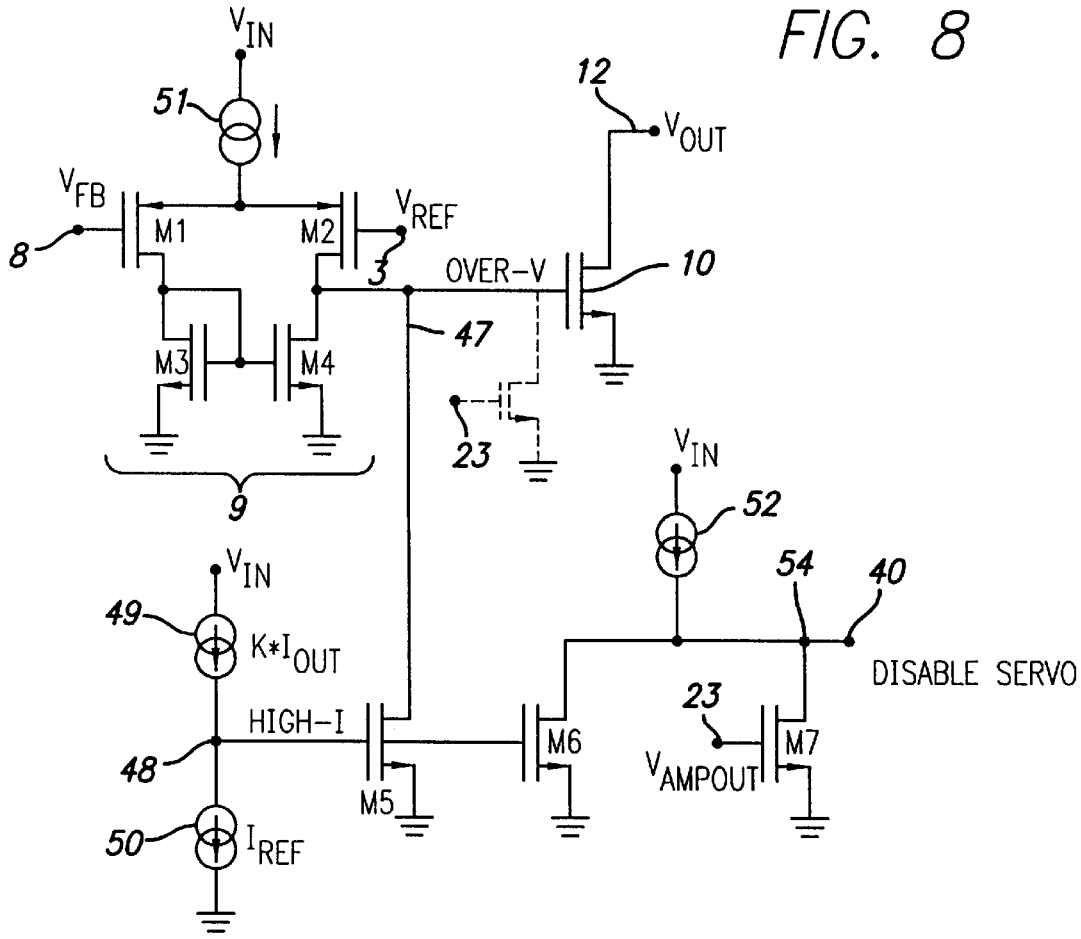
FIG. 8 is a schematic diagram of an implementation of the circuitry in blocks 9, 11, 17, 41, 39 and 42 of FIG. 6.

FIG. 8 is a simplified schematic diagram showing a possible implementation of overvoltage comparator 9, voltage source 11, reference current comparator 17, comparator 41, AND gate 39, AND gate 21, and voltage source 42. In FIG. 8, offset comparator 9 includes P-channel transistors M1 and M2, N-channel transistors M3 and M4, and a constant current source 51. The sources of input transistors M1 and M2 are connected to one terminal of constant current source 51, the other terminal of which is connected to $V_{IN}$. The gate of transistor M1 is connected to the feedback signal $V_{FB}$ on conductor 8. The gate of transistor M2 is connected to receive $V_{REF}$ on conductor 3. The drain of transistor M1 is connected to the drain of transistor M3 and to the gates of transistors M3 and M4. The drains of transistors M2 and M4 are connected by conductor 47 to the gate of discharge transistor 10 and to the drain of an N-channel transistor MS. The gate of transistor MS is connected by conductor 48 to the gate of an N-channel transistor M6 and to a junction 48 between a current source 49 and a current source 50. One terminal of current source 49 is connected to conductor 48 and another terminal of current source 49 is connected to $V_{IN}$. One terminal of current source 50 is connected to conductor 48, and its other terminal is connected to ground. The sources of transistors M3, M4, M5, and M6 are connected to ground.

A current $K \cdot I_{OUT}$ flows through current source 49, and the constant reference current $I_{REF}$ of FIG. 6 flows through current source 50. The drain of transistor M6 is connected by conductor 40 (FIG. 6) to the drain of an N-channel transistor M7 and one terminal of a constant current source 52 having its other terminal connected to $V_{IN}$. The gate of transistor M7 is connected to conductor 23, and it source is connected to ground. Transistors M6 and M7 and constant current source 52 form AND gate 39.

If desired, a redundant N-channel transistor can be provided with its drain connected to conductor 47, its source connected to ground, and its gate connected to receive the $V_{AMPOUT}$ signal on conductor 23, as shown in dotted lines.

Referring to FIG. 9, one embodiment of above mentioned current sensor circuit 25 includes an N-channel current sensor transistor 4A having its gate connected to conductor 33, its drain connected to VIN, and its source connected by conductor 12A to both the (+) input of a differential amplifier 56 and the drain of an N-channel current mirror input transistor 58 having its source connected to ground. The (–) input of amplifier 56 is connected to $V_{OUT}$. The output of amplifier 56 is connected by conductor 57 to the gate electrode of current mirror input transistor 58 and to the gate electrode of an N-channel current mirror output transistor 59 having its source connected to ground. The drain of transistor 59 is connected by conductor 24 to the (–) input of current comparator 17.

Current sensor circuit 25 operates as follows. Differential amplifier 56 drives the gate of transistor 58 such that its drain current, which also flows through the source of current sensor transistor 4A, causes the voltage of the source of current sensor transistor 4A to be equal to the source voltage $V_{OUT}$ of output transistor 4. The channel-width-to-channel-length ratio of current sensor transistor 4A is chosen to be approximately 1000 times less than that of output transistor 4, so the source current of current sensor transistor 4A is one 1000th of the source current $I_{OUT}$ of output transistor 4, if the current through resistors 5 and 6 is negligible. The source current of current sensor transistor 4A is mirrored by transistors 58 and 59 to provide an input current to the (–) input of current comparator 17.

The described invention provides an LDO voltage regulator that speeds the recovery from a $V_{OUT}$ overvoltage event without excessively increasing power dissipation. In order to speed recovery from such a $V_{OUT}$ overvoltage event, discharge transistor 10 is geometrically sized so as to carry a substantial portion of the full-scale output current, but is not so large as to consume an undesirably large amount of chip area. More importantly, discharge transistor 10 is turned on only if (1) the $V_{OUT}$ overvoltage is sufficiently large, and (2) the load current still flowing in the load is not large enough to adequately dissipate the $V_{OUT}$ overvoltage. Otherwise, discharge transistor 10 is not turned on at all, because the "remaining" load current by itself is most effective at discharging the output capacitance $C_{OUT}$, and this has the advantage that discharging of the $V_{OUT}$ overvoltage by the "remaining" load current does not cause any additional chip heating.

This makes it practical to provide an inexpensive, small, low-power LDO voltage regulator packaged in a small, surface-mount plastic package.

While the invention has been described with reference to several particular embodiments thereof, those skilled in the art will be able to make the various modifications to the described embodiments of the invention without departing from the true spirit and scope of the invention. It is intended that all elements or steps which are insubstantially different or perform substantially the same function in substantially the same way to achieve the same result as what is claimed are within the scope of the invention. For example, in most of the embodiments described, a P-channel output transistor 4 could be used if the circuitry were modified slightly to produce the correct polarity gate drive voltage on conductor 33. The described voltage regulators could be easily modified to provide a negative regulated output voltage from a negative unregulated input voltage. The output transistor 4 can have its drain connected to $V_{OUT}$ conductor 12 and its source connected to VIN conductor 7 instead of the opposite arrangement shown in the drawings.

What is claimed is:

1. A voltage regulator comprising:

(a) an error amplifier having a first input coupled to a first reference voltage, a second input receiving a feedback signal, and an output producing a first control signal;

(b) an output transistor having a gate, a first electrode coupled to an input voltage, and a second electrode coupled to produce a regulated output voltage on an output conductor;

(c) a feedback circuit coupled between the output conductor and a second reference voltage, the feedback circuit producing the feedback signal;

(d) an overvoltage comparator having a first input coupled to receive the first reference voltage, a second input coupled to respond to the feedback signal to produce a discharge control signal indicating occurrence of an output overvoltage of at least a predetermined magnitude; and (e) a discharge transistor coupled between the output conductor and the second reference voltage and having a gate responsive to the discharge control signal to discharge the output overvoltage if the output overvoltage is of at least the predetermined magnitude.

2. The voltage regulator of claim 1 wherein the first electrode is a drain and the second electrode is a source.

3. A voltage regulator comprising:

(a) an error amplifier having a first input coupled to a first reference voltage, a second input receiving a feedback signal, and an output producing a first control signal;

(b) an output transistor having a gate, a drain coupled to an input voltage, and a source coupled to produce a regulated output voltage on an output conductor;

(c) a feedback circuit coupled between the output conductor and a second reference voltage, the feedback circuit producing the feedback signal;

(d) an overvoltage comparator having a first input coupled to receive the first reference voltage, a second input coupled to respond to the feedback signal to produce a discharge control signal indicating occurrence of an output overvoltage of at least a predetermined magnitude; and (e) a discharge transistor coupled between the output conductor and the second reference voltage and having a gate responsive to the discharge control signal to discharge the output overvoltage if the output overvoltage is of at least the predetermined magnitude.

4. The voltage regulator of claim 3 including an offset voltage source coupled between the second output of the overvoltage comparator and a conductor conducting the feedback signal.

5. The voltage regulator of claim 3 including:

an output current sensing circuit operative to produce a control current representative of the drain current of the output transistor, a current comparator having an output, a first input coupled to receive a reference current and a second input coupled to receive the control current representative of the drain current of the output transistor, and an ANDing circuit having a first input coupled to the output of the overvoltage comparator, a second input coupled to the output of the current comparator, and an output coupled to the gate of the discharge transistor wherein the output overvoltage can be discharged by a remaining portion of a load current flowing to the output conductor.

6. The voltage regulator of claim 3 including:

an offset capacitor coupled between the output of the error amplifier and the gate of the output transistor, and a servo amplifier having a first input coupled to receive a third reference voltage, a second input coupled to the output of the error amplifier, and an output coupled to the gate of the output transistor to produce a second control signal thereon.

7. The voltage regulator of claim 6 wherein the servo amplifier has an enable input coupled to the output of the overvoltage comparator to prevent the servo amplifier from discharging the offset capacitor during an output overvoltage of at least the predetermined magnitude.

8. The voltage regulator of claim 6 including a low current charge pump circuit coupled to supply an output current into a supply voltage terminal of the servo amplifier.

9. The voltage regulator of claim 6 wherein the servo amplifier operates to maintain an offset voltage across the offset capacitor.

10. The voltage regulator of claim 9 wherein the offset voltage is equal to the difference required between the first control signal and the second control signal to produce the desired regulated output voltage.

11. The voltage regulator of claim 5 including:

an offset capacitor coupled between the output of the error amplifier and the gate of the output transistor, and a servo amplifier having a first input coupled to receive a third reference voltage, a second input coupled to the output of the error amplifier, and an output coupled to the gate of the output transistor to produce a second control signal thereon.

12. The voltage regulator of claim 11 wherein the servo amplifier operates to maintain an offset voltage across the offset capacitor.

13. The voltage regulator of claim 12 wherein the offset voltage is equal to the difference required between the first control signal and the second control signal to produce the desired regulated output voltage.

14. The voltage regulator of claim 11 including a low current charge pump circuit coupled to supply an output current into a supply voltage terminal of the servo amplifier.

15. The voltage regulator of claim 6 including:

an output current sensing circuit operative to produce a control current representative of the source current of the output transistor, a current comparator having an output, a first input coupled to receive a reference current and a second input coupled to receive the control current representative of the source current of the output transistor, and an ANDing circuit having a first input coupled to the output of the overvoltage comparator, a second input coupled to the output of the current comparator, and an output coupled to the gate of the discharge transistor.

16. The voltage regulator of claim 15 wherein the servo amplifier has an enable input coupled to the output of the ANDing circuit to prevent the servo amplifier from discharging the offset capacitor during a qualified output overvoltage and wherein the output overvoltage is at least of the predetermined magnitude and the source current of the output transistor is less than the reference current.

17. A method of providing a regulated output voltage, comprising:

(a) providing i. an error amplifier having a first input coupled to a first reference voltage, a second input receiving a feedback signal, and an output producing a first control signal, ii. an output transistor having a gate, a drain coupled to an input voltage, and a source coupled to produce a regulated output voltage on an output conductor, iii. a feedback circuit coupled between the output conductor and a second reference voltage, the feedback circuit producing the feedback signal, and iv. a discharge transistor coupled between the output conductor and the second reference voltage and having a gate responsive to the discharge control signal;

(b) providing an overvoltage comparator having a first input coupled to receive the first reference voltage, and a second input coupled to respond to the feedback signal; and (c) operating the overvoltage comparator to produce the discharge control signal in response to the occurrence of an output overvoltage of at least a predetermined magnitude so as to discharge the output overvoltage if the output overvoltage is of at least the predetermined magnitude.

18. The method of claim 17 wherein step (b) includes coupling the second input of the overvoltage comparator to the feedback signal by means of an offset voltage source.

19. The method of claim 17 wherein the overvoltage comparator has a signal delay characteristic which is substantially less than a signal delay characteristic associated with the error amplifier, and wherein step (c) produces the discharge control signal substantially before the overvoltage comparator can respond to a value of the feedback signal representative of the output overvoltage.

20. The method of claim 17 including:

coupling an offset capacitor between the output of the error amplifier and the gate of the output transistor, and providing a servo amplifier and applying a third reference voltage to a first input of the servo amplifier, coupling the output of the error amplifier to a second input of the servo amplifier, and operating the servo amplifier to produce a second control signal on the gate of the output transistor and maintain a corresponding offset voltage across the offset capacitor.

21. The method of claim 20 including operating a low current charge pump circuit to supply a supply current into a supply voltage terminal of the servo amplifier.

22. The method of claim 20 including operating the servo amplifier so as to maintain the offset voltage across the offset capacitor by producing values of the second control signal as required to cause the first control signal produced by the error amplifier to the equal to the third reference voltage.

23. The method of claim 22 wherein the offset voltage is equal to the difference required between the first control signal and the second control signal to produce the desired regulated output voltage.

24. The method of claim 17 including:

providing an output current sensing circuit and operating the output sensing circuit to produce a control current representative of the drain current of the output transistor, providing a current comparator having an output, a first input coupled to receive a reference current and a second input coupled to receive the control current and operating the current comparator to produce a signal indicative of whether the control current is less than the reference current, and providing an ANDing circuit having a first input coupled to the output of the overvoltage comparator, a second input coupled to the output of the current comparator, and an output coupled to the gate of the discharge transistor and operating the ANDing circuit to produce the discharge control signal if the output overvoltage exceeds the predetermined magnitude and the control current is less than the reference current to permit the output overvoltage to be discharged slowly by a remaining portion of an output current flowing through the output conductor.

25. The method of claim 24 wherein the overvoltage comparator has a signal delay characteristic which is substantially less than a signal delay characteristic associated with the error amplifier, and wherein step (c) produces the discharge control signal substantially before the overvoltage comparator can respond to a value of the feedback signal representative of the output overvoltage.

26. The method of claim 24 including:

coupling an offset capacitor between the output of the error amplifier and the gate of the output transistor, and providing a servo amplifier and applying a third reference voltage to a first input of the servo amplifier, coupling the output of the error amplifier to a second input of the servo amplifier, and operating the servo amplifier to produce a second control signal on the gate of the output transistor and maintain an offset voltage across the offset capacitor.

27. The method of claim 26 including operating a low current charge pump circuit to supply an output current into a supply voltage terminal of the servo amplifier.

28. The method of claim 26 including operating the servo amplifier so as to maintain the offset voltage across the offset capacitor by producing values of the second control signal as required to cause the first control signal produced by the error amplifier to the equal to the third reference voltage.

29. The method of claim 28 wherein the offset voltage is equal to the difference required between the first control signal and the second control signal to produce the desired regulated output voltage.

30. The method of claim 20 including varying the third reference voltage in accordance with the source current of the output transistor to improve the dynamic range of the source current of the output transistor.

* * * * *